US007717721B2

(12) United States Patent
Wu et al.

(10) Patent No.: US 7,717,721 B2
(45) Date of Patent: May 18, 2010

(54) CARD EDGE CONNECTOR WITH IMPROVED SPACER

(75) Inventors: Ren-Fu Wu, Kunshan (CN); Wen-Jun Tang, Kunshan (CN); Xue-Wu Bu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/472,395

(22) Filed: May 27, 2009

(65) Prior Publication Data

US 2009/0298305 A1 Dec. 3, 2009

(51) Int. Cl.
*H01R 12/00* (2006.01)

(52) U.S. Cl. ..... 439/79; 439/541.5; 439/540.1

(58) Field of Classification Search ..... 439/79, 439/540.1, 541.5, 701
See application file for complete search history.

(56) References Cited

U.S. PATENT DOCUMENTS 5,460,537 A 10/1995 Noschese
6,116,917 A 9/2000 Choy
2003/0008552 A1* 1/2003 Lin ..... 439/541.5
2003/0166348 A1* 9/2003 Martin et al. ..... 439/79
2003/0166349 A1* 9/2003 Huss et al. ..... 439/79
2007/0178724 A1* 8/2007 Kemp et al. ..... 439/79
2007/0232131 A1* 10/2007 Ju ..... 439/541.5

* cited by examiner

*Primary Examiner*—Hien Vu
(74) *Attorney, Agent, or Firm*—Wei Te Chung; Andrew C. Cheng; Ming Chieh Chang

(57) ABSTRACT

A card edge connector for connecting a daughter board to a mother board, includes an insulative housing defining a front mating face, a top portion, a bottom portion opposite to the top portion, and a central slot recessed from the mating face between the top portion and the bottom portion to receive the daughter board, a plurality of terminals retained in the insulative housing, and a spacer disposed under the insulative housing. The spacer having a preselected height and a mounting surface toward the mother board. The spacer and the bottom portion of the insulative housing are assembled by snap-fastening.

7 Claims, 6 Drawing Sheets

CARD EDGE CONNECTOR WITH IMPROVED SPACER

BACKGROUND OF THE INVENTION

1. Field of the Invention

The present invention generally relates to a card edge connector, and particularly relates to a card edge connector having an improved spacer for adjusting the height of the card edge connector.

2. Description of Related Art

A card edge connector is widely used to connect a daughter board to a mother board. A conventional card edge connector comprises an insulative housing as one-piece, and a plurality of terminals received in the insulative housing. The insulative housing includes a front wall, a rear wall opposite to the front wall, and a central slot recessed from a front face thereof and disposed between the front wall and the rear wall for receiving the daughter board. When the daughter board is inserted into the central slot, there is a litter space between the daughter board and the mother board along a height direction of the insulative housing, the space between the daughter board and the mother board is not big enough to receive other electrical elements.

Hence, it is desirable to have an improved card edge connector to overcome the above-mentioned disadvantages of the related art.

SUMMARY OF THE INVENTION

According to one aspect of the present invention, a card edge connector for connecting a daughter board to a mother board, comprises an insulative housing defining a front mating face, a top portion, a bottom portion opposite to the top portion, and a central slot recessed from the mating face between the top portion and the bottom portion for receiving the daughter board, a plurality of terminals retained in the insulative housing and extending into the central slot to electrically and mechanically engaging with the daughter board, wherein both of the top portion and the bottom portion define a plurality of receiving passages to receive the terminals, and a spacer disposed under the insulative housing. wherein the spacer having a preselected height and a mounting surface toward the mother board. wherein the spacer and the bottom portion of the insulative housing are assembled by snap-fastening. wherein the spacer includes a base portion, a support portion extending forwardly from the base portion, and a stopper portion protruding upwardly from the base portion. The insulative housing is supported on the support portion. The stopper portion is disposed behind the insulative housing to prevent the inusulaive housing from moving rearwardly.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE PREFERRED EMBODIMENT

Figure 1:
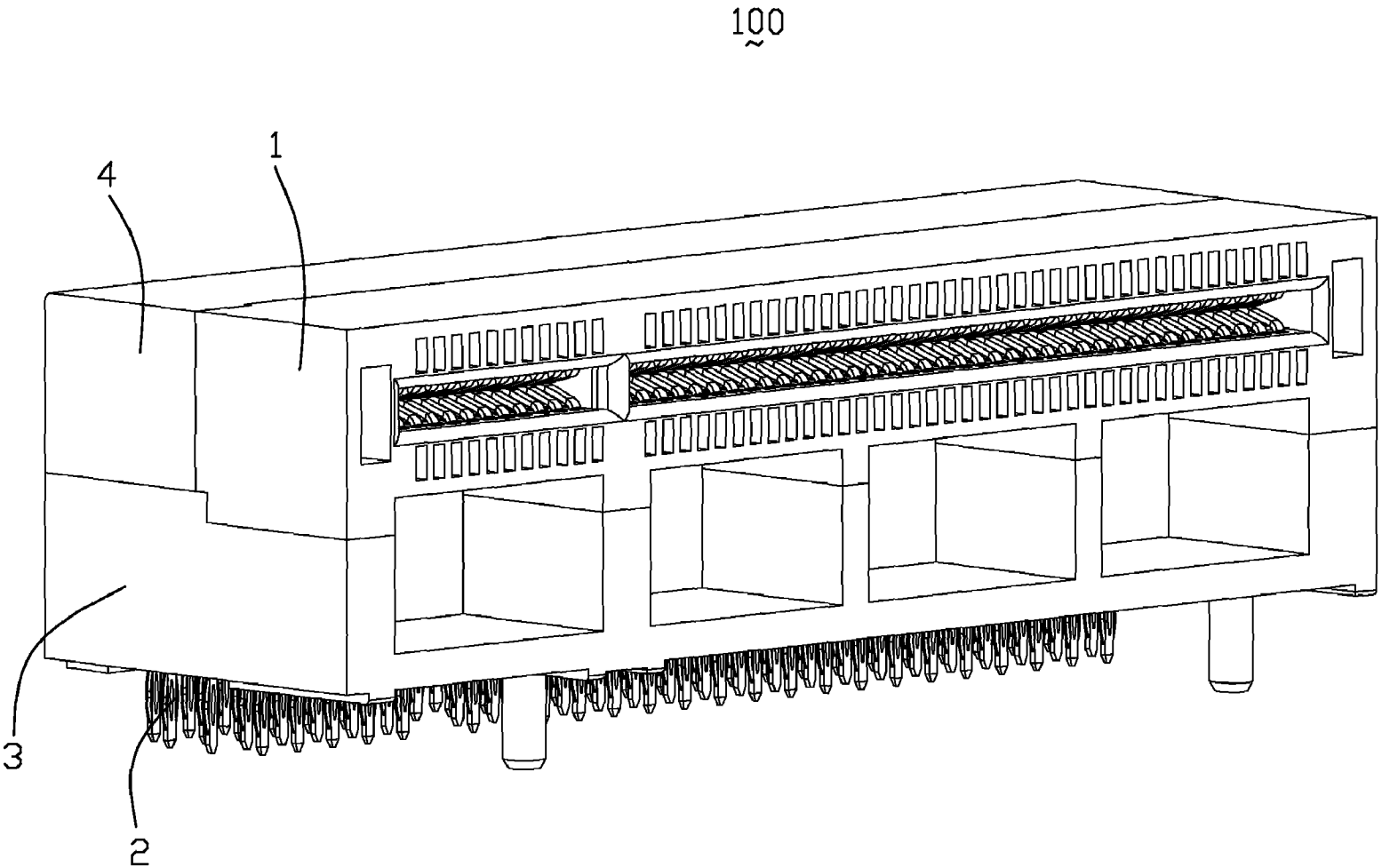
FIG. 1 is a front perspective view of a card edge connector according to a preferred embodiment of the present invention.

Reference will now be made to the drawing figures to describe the present invention in detail.

Figure 2:
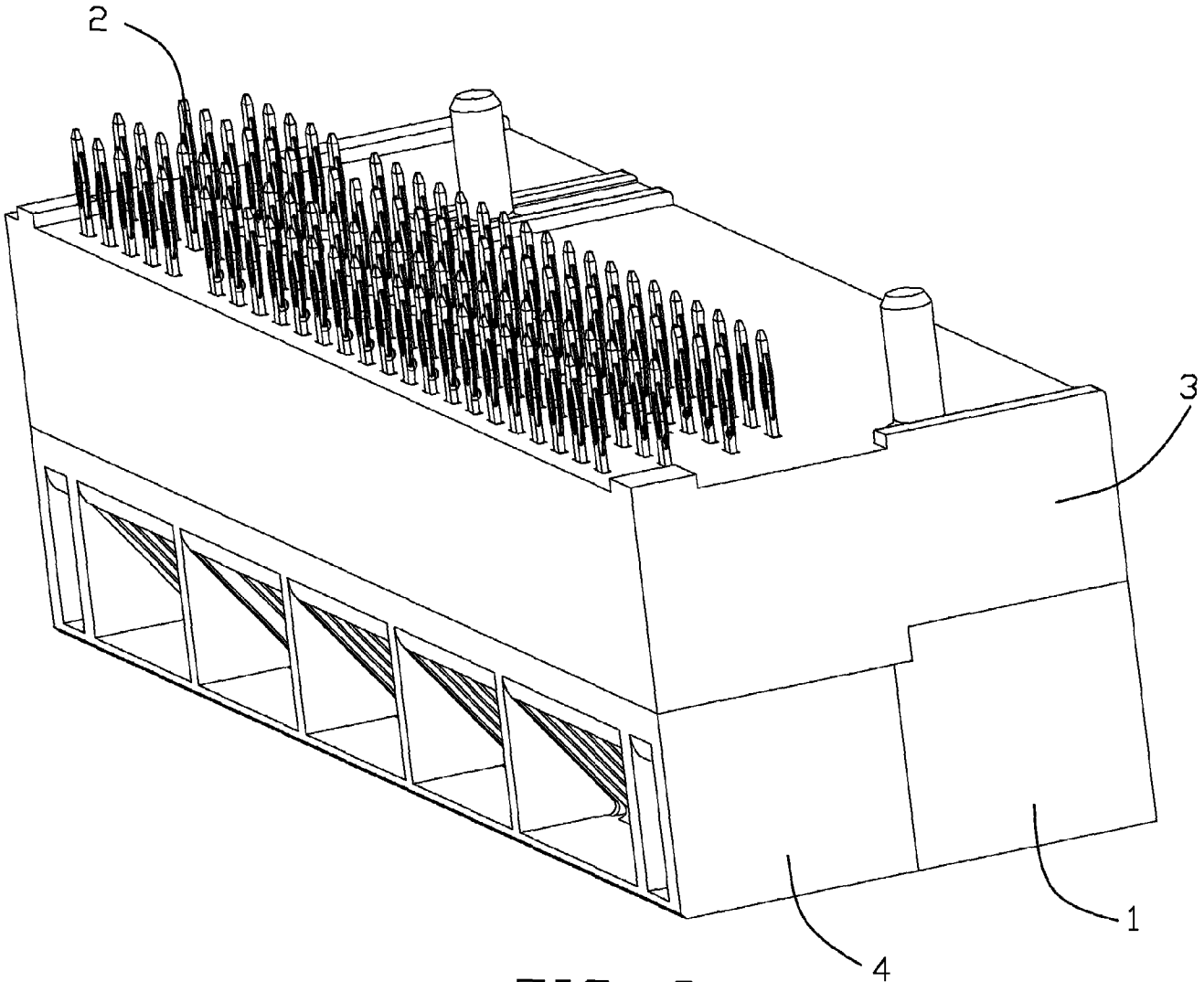
FIG. 2 is a bottom perspective view of the card edge connector of FIG. 1.
Figure 3:
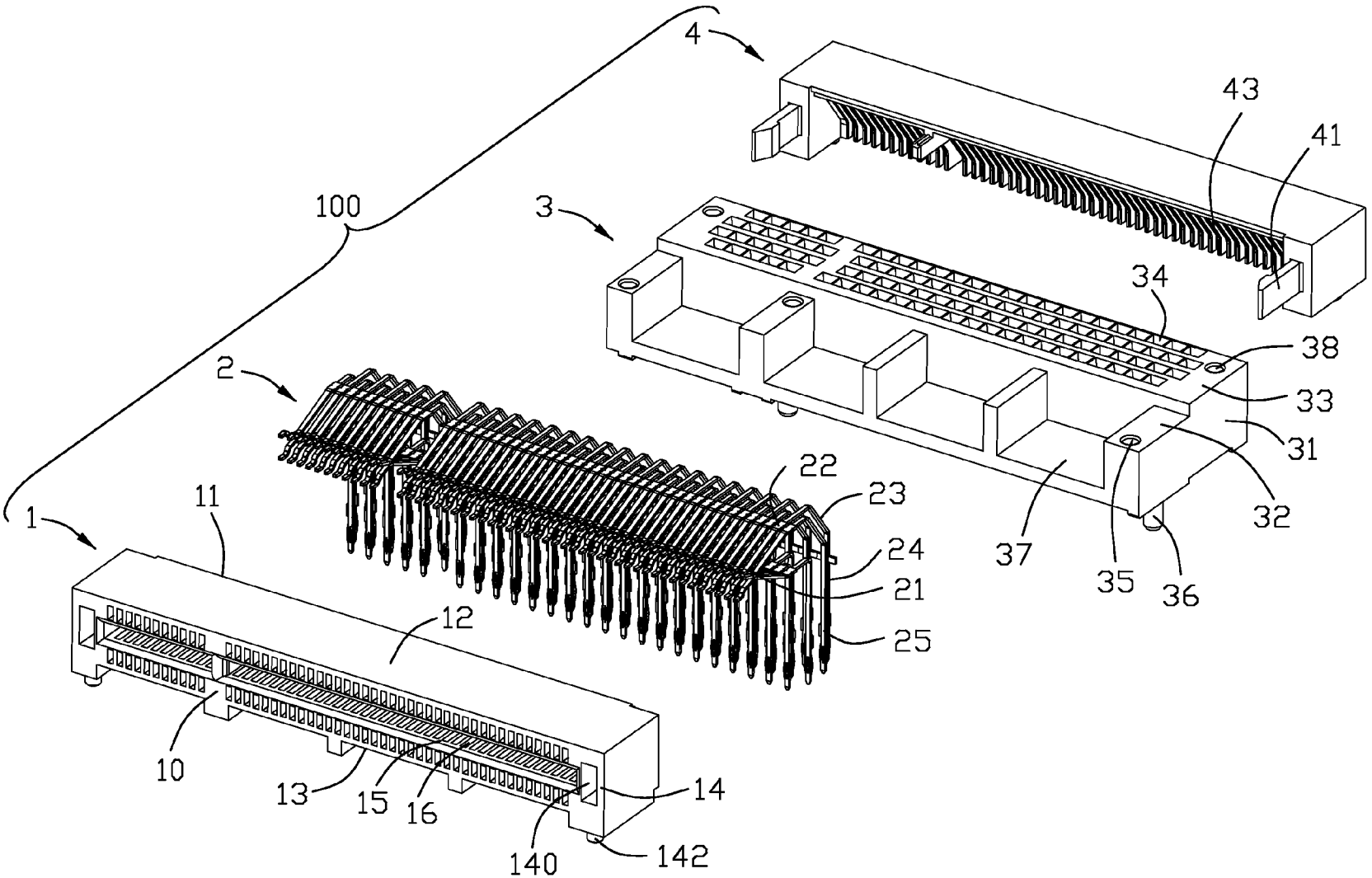
FIG. 3 is an exploded perspective view of the card edge connector of FIG. 1.
Figure 4:
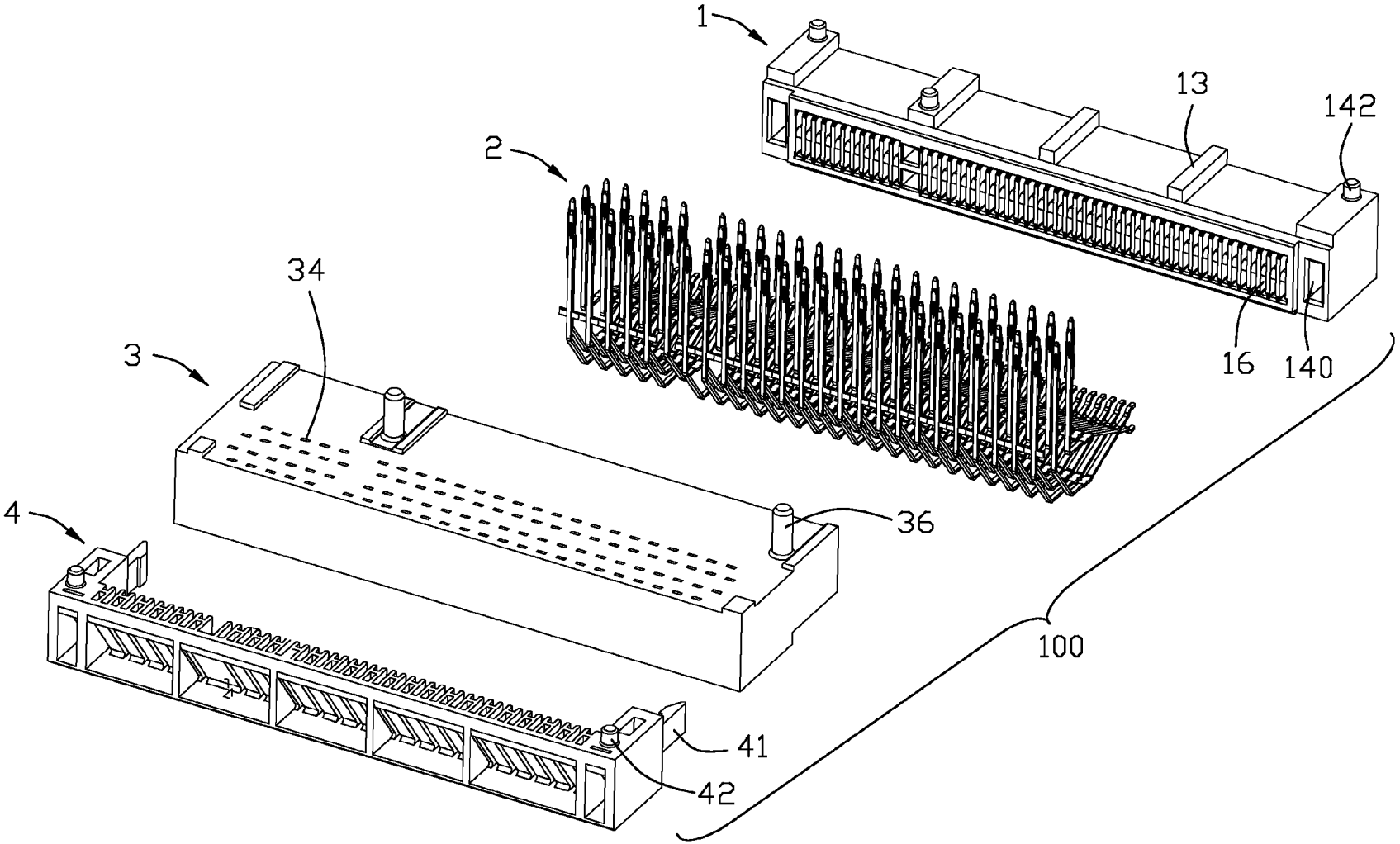
FIG. 4 is an another exploded perspective view of the card edge connector of FIG. 1.
Figure 5:
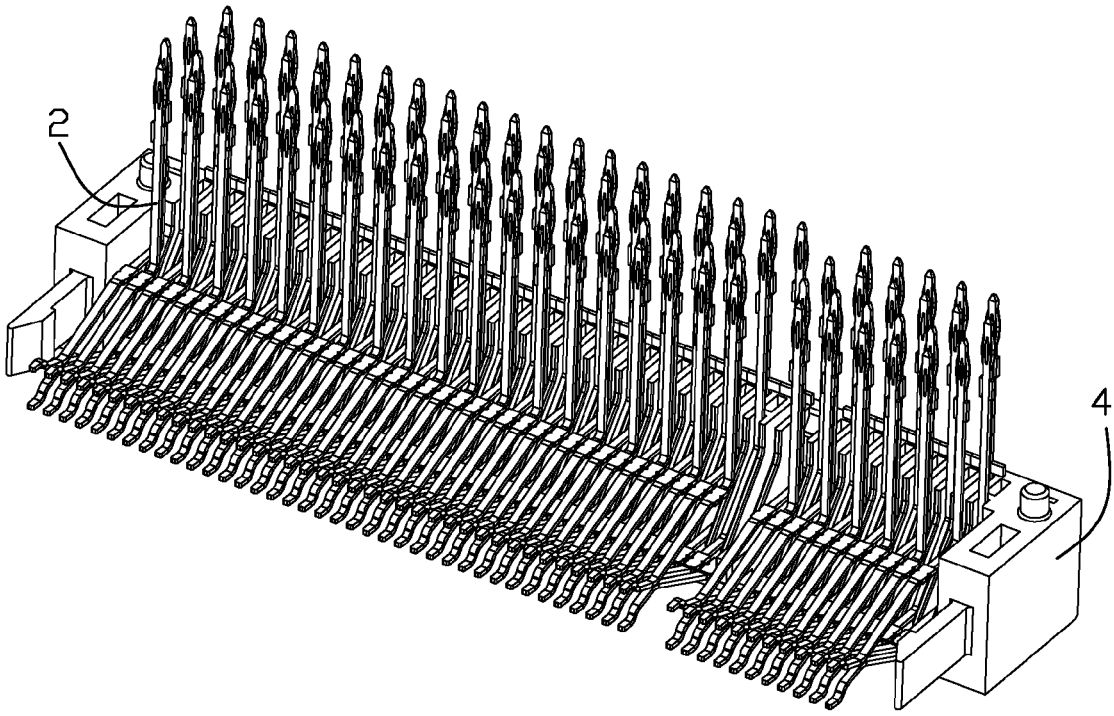
FIG. 5 is an inner perspective view of a plurality of terminals engaging with a cover of the card edge connector of FIG. 1.
Figure 6:
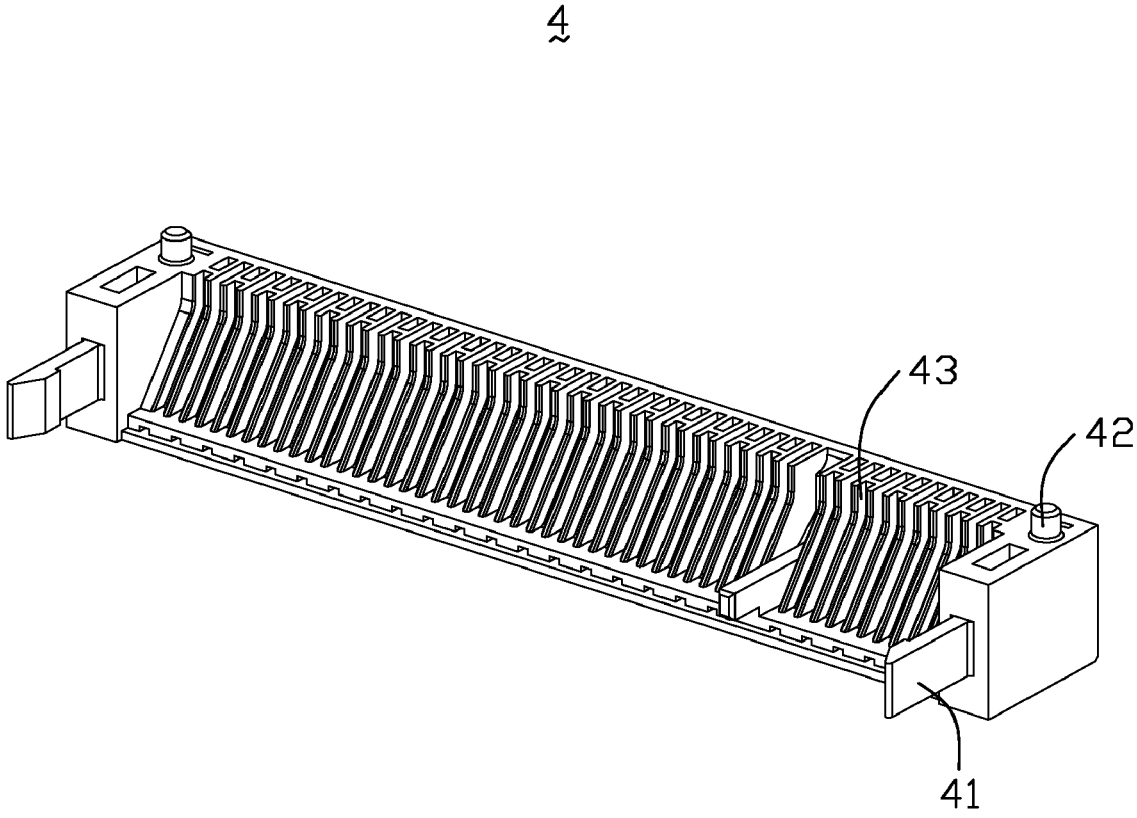
FIG. 6 is an inner perspective view of a cover of the card edge connector of FIG. 1.

With reference to FIGS. 1-6, a card edge connector 100 in accordance with the present invention for connecting a daughter board (not shown) to a mother board (not shown) includes an insulative housing 1, a plurality of terminals 2 retained in the insulative housing 1, a spacer 3 fixed on a bottom portion of the insulative housing 1, a cover 4 attached to the insulative housing 1 and the spacer 3.

The insulative housing 1 includes a front mating face 10, a rear portion 11 opposite to the mating face 10, a top portion 12, a bottom portion 13 opposite to the top portion 12, two opposite side ends 14, and a central slot 15 recessed rearwardly from the mating face 10 and disposed between the top portion 12 and the bottom portion 13. The central slot 15 is also disposed between the side ends 14. Two rows of receiving passages 16 are formed in the top portion 12 and the bottom portion 13. The receiving passages 16 communicate to the central slot 15 and extend backwardly through the rear portion 11 of the insulative housing 1. A pair of latch holes 140 are recessed rearwardly from the mating face 10 through opposite side ends 14 to secure the cover 4. The side ends 14 each defines two circle first protrusions 142 extending downwardly out of the bottom portion 13 to be retained on the mother board. The bottom portion 13 forms another circle first protrusion 142 under the central slot 15.

The terminals 2 each defines a first securing portion 22 retained in the receiving passage 16 of the insulative housing 1, a contact portion 21 extending forwardly from the first securing portion 22 into the central slot 15 to electrically and mechanically engaging with the daughter board, a vertical second securing portion 24, a soldering tail 25 extending downwardly from the second securing portion 24 to be soldered on the mother board, and a bending portion 23 between the first securing portion 22 and the second securing portion 24.

The spacer 3 has a preselected height and includes a base portion 31, a support portion 32 extending forwardly from the base portion 31 to support the insulative housing 1, and a stopper portion 33 protruding upwardly from the base portion 31. The stopper portion 33 is higher than the support portion 32 and disposed behind the support portion 32 to prevent the insulative housing 1 from moving rearwardly. A plurality of through holes 34 extend downwardly through both the stopper portion 33 and the base portion 31 respectively. The second securing portions 24 of the terminals 2 are retained in the through holes 34 respectively. The soldering tails 25 extend downwardly out of the spacer 3.

The support portion 32 forms three circle first depressions 35 corresponding to the first protrusions 142 of the insulative housing 1 on a top surface thereof, a plurality of posts 36 extending downwardly to be mounted in position holes of the mother board, and a plurality of openings 37 recessed from a top surface thereof and extending through therein in a front-to-back direction to reduce weight thereof. The first protrusions 142 of the insulative housing 1 are solidly attached to the first depressions 35 of the spacer 3. The stopper portion 33 also forms two second depressions 38 on opposite ends thereof. The central slot 15 is raised after the spacer 3 solidly attached to the insulative housing. A space between the daughter board and the mother board along a height direction of the insulative housing 1 would be big enough to receive other electrical elements.

The cover 4 is made of insulative material. The cover 4 defines a pair of latch arms 41 extending forwardly from opposite end sides thereof to be inserted into the latch holes 140 of the insulative housing 1, two circle protrusions 42 are solidly attached to the second depressions 38 of the spacer 3, and a plurality of retaining cavities 43 disposed on an inner wall thereof for retaining the bending portion 23 of the terminals 2.

The insulative housing 1 and the cover 4 each defines a top surface, opposite lateral surface. The spacer 3 defines a rear surface, a mounting surface opposite to the top surface of the insulative housing 1 and disposed toward the mother board, and two opposite lateral surfaces. The cover 4 defines a rear surface too. The top surfaces of the insulative housing 1 and the cover 4 are in a same level plane. The lateral surfaces of the insulative housing 1, the spacer 3 and the cover 4 are in a vertical plane. The rear surface of the spacer 3 and the cover 4 are in another vertical plane.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for connecting a daughter board to a mother board, comprising:

an insulative housing defining a front mating face, a top portion, a bottom portion opposite to the top portion, and a central slot recessed from the mating face between the top portion and the bottom portion to receive the daughter board;

a plurality of terminals retained in the insulative housing and extending into the central slot to electrically and mechanically engage with the daughter board, wherein both of the top portion and the bottom portion define a plurality of receiving passages to receive the terminals; and a spacer disposed under the insulative housing, wherein the spacer having a preselected height and a mounting surface toward the mother board;

wherein the spacer and the bottom portion of the insulative housing are assembled by snap-fastening;

wherein the spacer includes a base portion, a support portion extending forwardly from the base portion, and a stopper portion protruding upwardly from the base portion, the insulative housing is supported on the support portion, said the stopper portion is disposed behind the insulative housing to prevent the insulative housing from moving rearwardly;

wherein the spacer defines a plurality of through holes in alignment with the terminals respectively, the through holes extend through the base portion and the stopper portion in an upper-to-lower direction;

wherein the card edge connector further includes a cover stacked on the stopper portion and disposed behind the insulative housing, the cover and the spacer are assembled by snap-fastening too; and wherein the insulative housing defines a pair of latch holes formed on opposite ends thereof and disposed at an outer sides of the central slot, the latch holes extend through the insulative housing in a front-to-rear direction, the cover defines a pair of latch arms corresponding to the latch holes for latching.

2. The card edge connector as claimed in claim 1, wherein the spacer defines at least one depressions, the bottom portion of the insulative housing defines at least on one protrusions solidly attached to the depressions.

3. The card edge connector as claimed in claim 1, wherein the terminals each includes a contact portion extending into the central slot, a first securing portion retained in the insulative housing, a second securing portion received in the through hole of the spacer, a soldering tail extending downwardly out of the spacer from the second securing portion, and a bending portion between the first securing portion and the second securing portion, said the cover defines a plurality of retaining cavities disposed on a inner wall thereof to receive the bending portions of the terminals.

4. The card edge connector as claimed in claim 1, wherein the spacer defines a plurality of posts extending outside the mounting surface to be mounted in position holes of the mother board.

5. The card edge connector as claimed in claim 1, wherein the insulative housing and the cover each defines a top surface, opposite lateral surface, the spacer defines a rear surface, and two opposite lateral surfaces, the cover defines a rear surface, the top surfaces of the insulative housing and the cover are in a same level plane, the lateral surfaces of the insulative housing, the spacer and the cover are in a same vertical plane, the rear surface of the spacer and the cover are in another same vertical plane.

6. A card edge connector for connecting a daughter board to a mother board, comprising:

an insulative housing defining a front mating face, a top surface, a bottom surface opposite to the top surface, two opposite side surfaces, and a central slot recessed rearwardly from the mating face;

a plurality of terminals retained in the insulative housing and extending into the central slot to electrically and mechanically engaging with the daughter board;

a spacer solidly attached to the bottom portion of the insulative housing, wherein the spacer having a preselected height, a mounting surface toward the mother board, a front surface, a rear surface opposite to the front surface, two opposite side surface, and a plurality of through holes in alignment with the terminals; and a rear cover solidly attached to a rear portion of the insulative housing and a top portion of the spacer, the rear cover defines a top surface disposed in a same plane with the top surface of the insulative housing, a rear surface disposed in a same plane with the rear surface of the spacer, two opposite side surfaces disposed in a same plane with the side surfaces of the insulative housing and the spacer respectively;

wherein the mating surface and the front surface of the spacer are in a same plane;

wherein the rear cover defines a plurality of retaining cavities disposed on an inner wall thereof to retain the terminals; and wherein the insulative housing defines a pair of latch holes formed on opposite ends thereof and disposed at an outer sides of the central slot, the latch holes extend through the insulative housing in a front-to-rear direction, the cover defines a pair of latch arms corresponding to the latch holes for latching.

7. The card edge connector as claimed in claim 6, wherein the insulative housing, the spacer and the rear cover are solidly attached to each other by snap-fastening.

* * * * *